United States Patent [19]

Lesscher

[11] Patent Number: 4,955,504

[45] Date of Patent: Sep. 11, 1990

[54] INJECTION-MOULDED PLASTIC LID FOR A CONTAINER AND A CONTAINER HAVING SUCH AN INJECTION-MOULDED PLASTIC LID

[75] Inventor: Bernardus A. Lesscher, Mariaparochie, Netherlands

[73] Assignee: Wavin B.V., Netherlands

[21] Appl. No.: 417,547

[22] Filed: Oct. 5, 1989

[30] Foreign Application Priority Data

Oct. 6, 1988 [NL] Netherlands ..... 8802456

[51] Int. Cl.[5] ..... B65D 43/08

[52] U.S. Cl. ..... 220/352; 220/321; 220/356; 215/344; 215/DIG. 1

[58] Field of Search ..... 220/306, 319, 320, 321, 220/352, 356, 357, 358; 215/344, DIG. 1

[56] References Cited

U.S. PATENT DOCUMENTS

| | | | |
|---|---|---|---|
| 3,532,244 | 10/1970 | Yates, Jr. | 215/DIG. 1 X |
| 3,568,871 | 3/1971 | Livingstone | 215/344 |
| 3,688,942 | 9/1972 | Mitchell et al. | 220/306 |
| 4,141,463 | 2/1979 | Smith | 220/359 |
| 4,360,114 | 11/1982 | Owens | 215/329 |
| 4,444,332 | 4/1984 | Widen et al. | 220/306 |
| 4,632,272 | 12/1986 | Berenfield et al. | 220/324 |
| 4,674,650 | 6/1987 | Hamilton et al. | 220/319 |
| 4,765,506 | 8/1988 | Fishman et al. | 220/355 |

*Primary Examiner*—Stephen Marcus
*Assistant Examiner*—Nova Stucker
*Attorney, Agent, or Firm*—Wigman & Cohen

[57] ABSTRACT

Injection-moulded plastic lid for a container having a first container upper rim part (15) which divergently adjoins the inner wall and which adjoins, via a sharp upper rim (28), an outwardly directed, downwardly sloping second container upper rim part (16) terminating in a downwardly directly apron (17) situated at a distance from the container wall. The plastic lid (2) comprises a first lid inside rim part (11) engaging said first container upper rim part, which first lid inside rim part merges, via a lid top inside rim (12) into a downwardly sloping second lid inside rim part (4) engaging said second container upper rim part (16). A circumferential chamber (29) is provided in said second lid inside rim part (4). Sealing means engaging the second container upper rim part to form a seal, are integral with the plastic lid and comprise three circumferential thin flaps the basis of said flaps (6, 7, 8) being firmly attached to the base of chamber (29) to form a subchamber (23, 24, 25) situated next to each flap and the free lower ends of the flaps extending past an imaginary conical surface (26) forming a continuation of the second lid inside rim part (4). Flap parts (**29*a*, 29*b*, 29*c*) situated outside the imaginary conical surface (26) are essentially of equal lengths. The bottom (5*a*) of the lid rim boundary part (5) extends to the conical surface (26) and the most inwardly situated flap (8) adjoins the second lid inside rim part (4). The flaps have a V-shaped cross section in the direction of their free ends. The lid rim boundary part (5) has a smaller outside diameter than the outside diameter of the apron (17**).

8 Claims, 3 Drawing Sheets

INJECTION-MOULDED PLASTIC LID FOR A CONTAINER AND A CONTAINER HAVING SUCH AN INJECTION-MOULDED PLASTIC LID

BACKGROUND OF THE INVENTION

The present invention relates to an injection-molded plastic lid for a container having a first container upper rim part which divergently adjoins the inner wall and which adjoins, via a sharp top rim, an outwardly directed, downwardly sloping second container upper rim part terminating in a downwardly direction apron situated at a distance from the container wall, said plastic lid comprising a first lid inside rim part being capable of engaging said first container upper rim part, which first lid inside rim part merges, via a lid top inside rim into a downwardly sloping second lid inside rim part being capable of engaging with said second container upper rim part, and also a circumferential chamber provided in said second lid inside rim part and sealing means capable of engaging with the second container upper rim part to form a seal.

Such an injection-molded plastic lid for a container for packaging plastic resins, such as polytetrafluoroethylene resin, is disclosed in U.S. Pat. No. 4,674,650. In this known plastic lid, a sealing ring capable of engaging with the second container upper rim part to form a seal has to be fitted in a circumferential chamber provided in the second lid inside rim part.

The fitting of said sealing ring in a circumferential chamber of the lid is, however, laborious and requires considerable time.

Another disadvantage is that, to obtain a reliable seal between the downwardly sloping second lid inside rim part and the second upper rim part of the container, in which there are often irregularities formed during the injection molding, very narrow tolerances have to be met in relation to the dimensions of the sealing ring or of the circumferential chamber provided in a second lid inside rim part.

SUMMARY OF THE INVENTION

An object of the invention is now to provide an injection-molded lid which ensures an absolutely reliable seal, is easy to manufacture and which necessitates no separate operation to fit sealing means in the circumferential chamber provided in the second lid inside rim part.

This object is achieved, according to the invention, in that the sealing means, being integral with the plastic lid, comprise at least two circumferential thin flaps, at least the bases of said flaps being firmly attached to the wall of the chamber to form a subchamber situated next to each flap and the free lower ends of the flaps extending past an imaginary conical surface forming a continuation of the second lid inside rim part.

Since the sealing means are integral with the plastic lid in this embodiment, it is no longer necessary to fit a sealing ring in a circumferential chamber in a separate operation, while, in addition, no particularly narrow tolerances need to be maintained in relation to the sealing means and the circumferential chamber.

By using at least two circumferential thin flaps whose free lower ends extend past an imaginary conical surface forming an extension of a second lid inside rim part, said free lower ends of the flaps are able to deform and adapt particularly well to the surface of the second container upper rim part when the plastic lid engages with the said container.

At least one flap advantageously extends from the base of the circumferential chamber. Consequently, such a flap has as great a length as possible, so that the flap is very flexible and, since the sealing ability depends to a large extent on the length, an excellent seal is obtained in this manner between lid inside and container upper rim.

Expediently, the most inwardly situated flap adjoins the second lid inside rim part since this flap can easily be formed during the injection molding and consequently a most inwardly situated sealing zone is produced. As a result of irregularities which often occur on the top rim of the container, this most inwardly situated flap will not usually be able to follow these irregularities and this leads to leakage. This drawback is eliminated by always using at least two circumferential thin flaps.

The bottom of the rim boundary part situated next to the chamber also extends to the said imaginary conical surface, while, in addition, the lid rim boundary part has a smaller outside diameter than the outside diameter of an apron situated downwards at a distance from a container wall. Since the lid boundary rim is of relatively stiff construction and in practice does not deform, or deforms very little, a certain limitation of the deformation distance of the free ends of the flaps is ensured and, in addition, a stop is formed which determines the extent to which a clamping strip is able to secure the lid on the container upper rim.

To obtain a large flexibility of the flaps, they advantageously have a V-shaped cross section in the direction of their free end.

The invention also relates to a container having a first container upper rim part divergently adjoining the inner wall and which adjoins, via a sharp top rim, an outwardly directed, downwardly sloping second container upper rim part terminating in a downwardly directed apron situated at a distance from the container wall, which container is provided with a lid according to the invention.

The invention will now be explained with reference to an exemplary embodiment by means of the drawings.

DETAILED DESCRIPTION OF PREFERRED EMBODIMENTS

Figure 1:
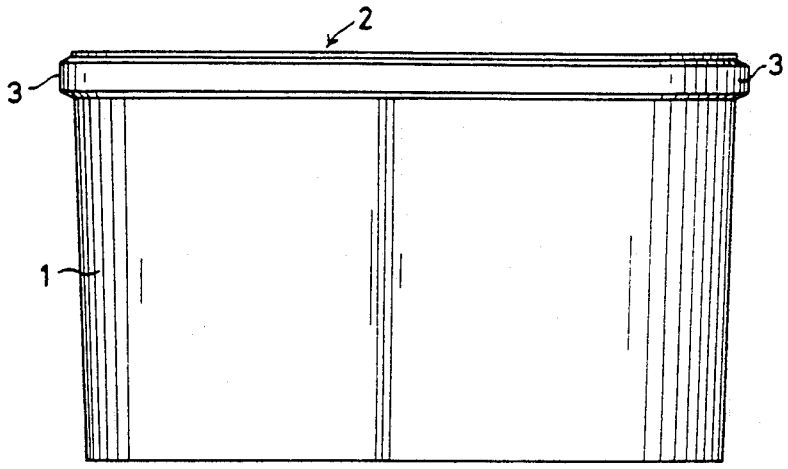
FIG. 1 shows a view of a container with injection-moulded plastic lid according to the invention.
Figure 5:
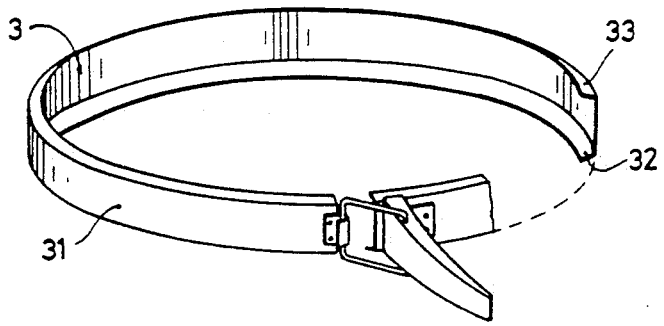
FIG. 5 shows a clamping strip used in the case of a lid with container according to the invention.
Figure 2:
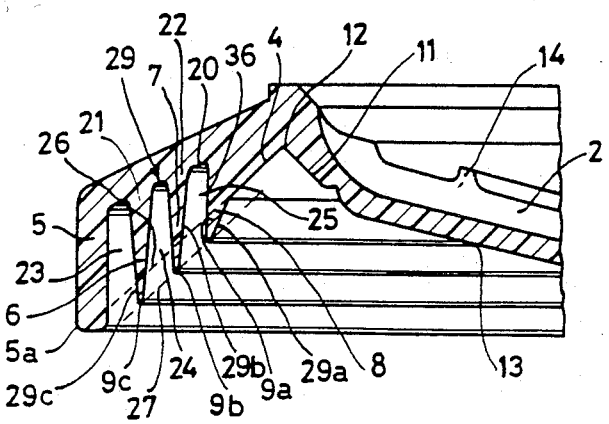
FIG. 2 shows a detail in cross section of an injection-molded plastic lid according to the invention.
Figure 3:
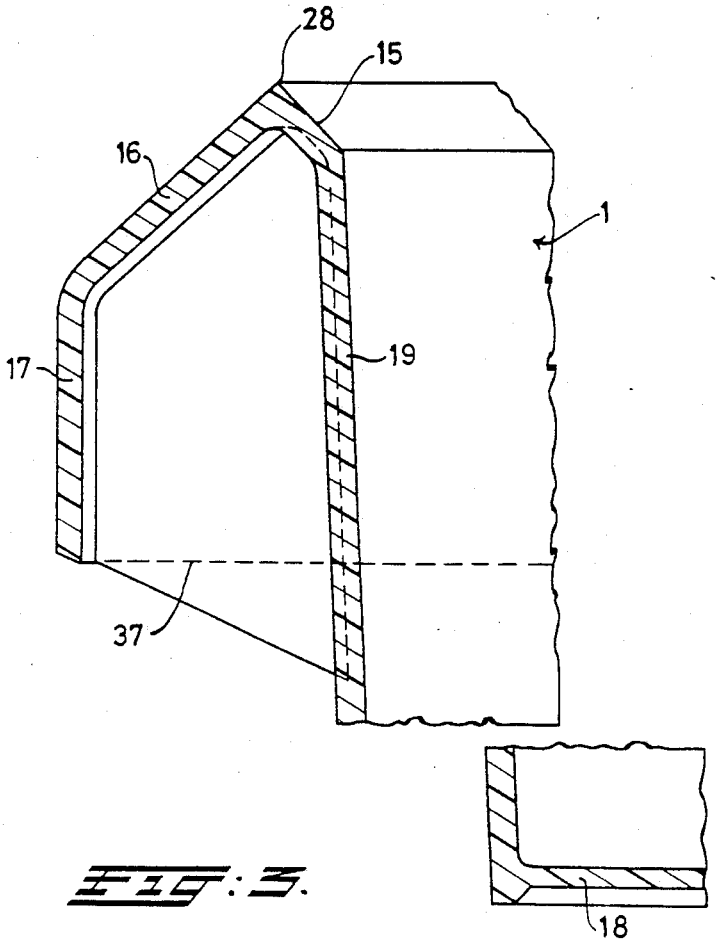
FIG. 3 shows a detail of a container used with such an injection-molded plastic lid.

FIG. 1 shows an injection-molded plastic lid 2 fitted on a plastic container 1 and is secured thereto in a clamping and sealing manner by means of a clamping strip 3. The plastic container 1 comprises a first container upper rim part 15 divergently adjoining the inner wall 19 and adjoining, via a sharp top rim 28, an outwardly directed, downwardly sloping second container upper rim part 16 which terminates in turn in a downwardly directed apron 17 which is situated at a distance from the container wall. Reinforcing partitions 37 may be fitted between said apron 17 and the container wall, so that an extremely rigid construction is obtained.

As a result of the diverging first container upper rim part 15 and the second container upper rim part 16, material contained in the container can easily be poured out, and material which is still in contact with the surface of the container upper rim part 15 after pouring out will slide back into the container before the latter is sealed again by the plastic lid. Material which has ended up on the downwardly sloping second container upper rim part 16 will also slide off this surface before the lid comes into contact therewith.

The flat first and second container upper rim parts 15 and 16 respectively expediently extend at an angle of approximately 45° with respect to the wall 19 of the container. The slope of the container upper rim parts 15, 16 is, however, determined by the material to be packed in the container.

The injection-molded plastic lid 2 according to the invention comprises a first lid inside rim part 11 which is matched to, and is capable of engaging with, the first container upper rim part 15. The first container upper rim part 11 merges via a lid top inside rim 12 into a downwardly sloping second lid inside rim part 4 which is matched to, and is capable of engaging with, the second container upper rim part 16.

A circumferential chamber 29 is provided in the second lid inside rim part 4, circumferential flaps 6, 7 and 8 which are V-shaped in cross section being present for the purpose of sealing. The bases 21 and 22 of the flaps 6 and 7 are integral with the base 35 of the circumferential chamber 29.

Situated on either side of flap 6 are the subchambers 23, 24, while flap 7 is bounded on either side by subchambers 24, 25.

The most inwardly situated flap 8 adjoins the second lid inside rim part 4 and the inside wall 36 of the circumferential chamber 29.

Above the base 35 of the circumferential chamber 29 there is, furthermore, a lid upper rim part 10.

To reinforce the lid, reinforcing ribs 14 are provided thereon. The inside of the lid, which essentially seals the container 1, is indicated by reference numeral 13.

The free lower ends **9*a*, 9*b*, 9*c* of the flaps 6, 7, 8 have a length such that the flap parts 29*a*, 29*b*, 29*c*, situated outside a first imaginary conical surface 26 are basically of the same length and are therefore situated via their ends, on a secondary imaginary conical surface 27**. Such an equal length is, however, not mandatorily specified.

The first imaginary conical surface 26 forms a continuation of the second lid inside rim part 4 at the position of the circumferential chamber.

The lid rim boundary part 5 is of relatively rigid construction and in practice does not deform, or deforms very little. A reliable limitation of the deformation distance of the flaps 6, 7, 8 is consequently ensured.

Figure 4:
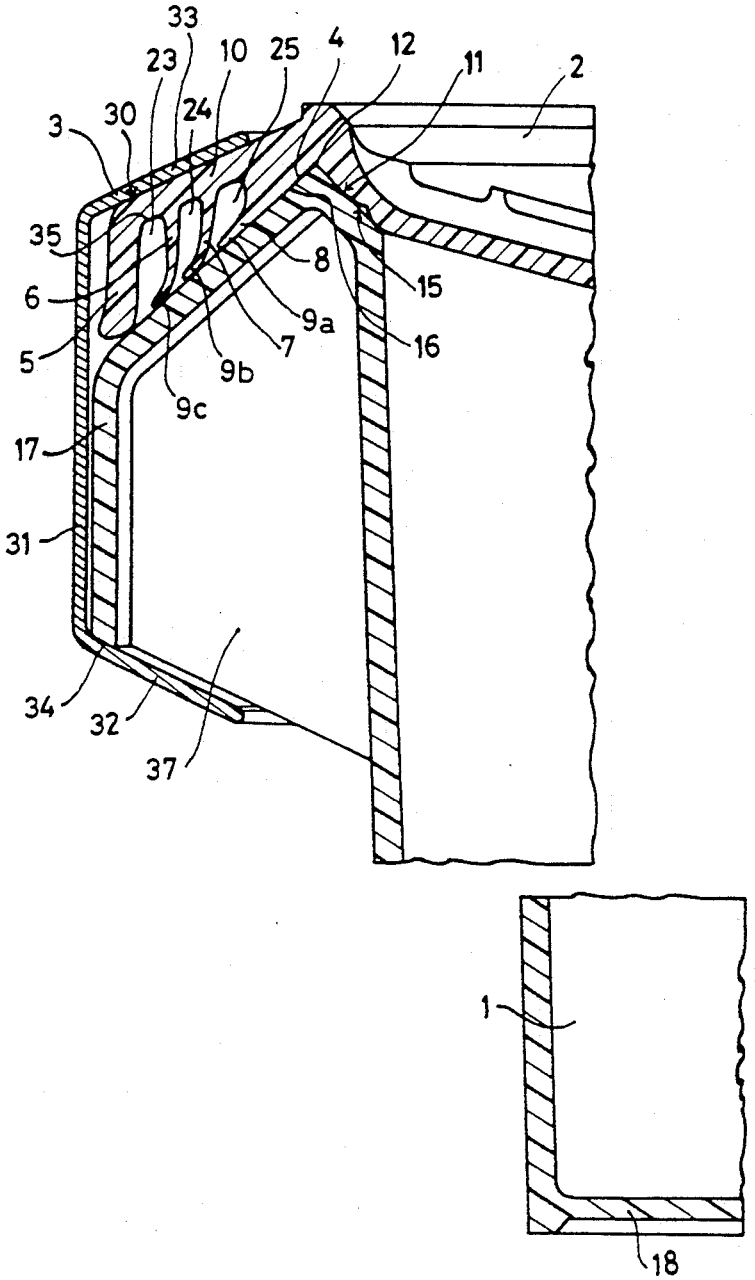
FIG. 4 shows a cross section, on an enlarged scale, of a part of an injection-molded plastic lid according to the invention fitted on a plastic container which mates therewith

FIG. 4 shows the manner in which the flaps 6, 7, 8 deform after the lid is placed on a container 1 to be sealed.

As is evident, the free ends **9*a*, 9*b*, 9*c* of the flaps are now deformed in an outward direction. By arranging for the bases 21, 22 of the flaps 6, 7 to be integral with the base 35 of the circumferential chambers 29, a good flexibility of the flaps 6, 7 is ensured, as a result of which said flaps ensure a particularly good seal between the outside of the container and the contents thereof. After the lid 2 has been fitted, the lid is secured on the upper rim of container 1 with the aid of a clamping strip 3. The circumferential section 31 of the clamping strip 3 follows the outside of the apron 17, while the clamping strip upper part 33 engages with the upper rim 10 of the lid and clamping strip lower rim 32 engages with the free end 34 of the apron 17 and any reinforcing partitions 37 of the lid boundary rim part 5**.

It will be clear that the outside diameter of the lid boundary rim part 5 does not need to be equal to the outside diameter of the apron 17, but it is, in fact, necessary to ensure that the difference between the two diameters is small and the lower rim **5*a* of the lid boundary rim part 5 is capable of resting on the upper surface 16 of the container without dropping past it in view of the clamping strip 3** to be fitted.

The flaps 6, 7 and 8 extend downwards essentially in an upright manner, as a result of which the lid 2 is an injection-molded product releasing very well.

What is claimed is:

1. Injection-molded plastic lid for a container having a first container upper rim part (15) which divergently adjoins the inner wall and which adjoins, via a sharp upper rim (28), an outwardly directed, downwardly sloping second container upper rim part (16) terminating in a downwardly directed apron (17) situated at a distance from the container wall, said plastic lid (2) comprising a first lid inside rim part (11) being capable of engaging said first container upper rim part, which first lid inside rim part merges, via a lid top inside rim (12) into a downwardly sloping second lid inside rim part (4) being capable of engaging said second container upper rim part (16), and also a circumferential chamber (29) provided in said second lid inside rim part (4) and sealing means capable of engaging the second container upper rim part to form a seal, wherein said sealing means, being integral with the plastic lid, comprise at least two circumferential thin flaps, at least the bases of said flaps (6, 7, 8) being firmly attached to the wall of the chamber (29) to form a subchamber (23, 24, 25) situated next to each flap and the free lower ends of the flaps extending past an imaginary conical surface (26) forming a continuation of the second lid inside rim part (4).

2. Injection-molded plastic lid according to claim 1, wherein at least one flap extends from the base of the circumferential chamber (29).

3. Injection-molded plastic lid according to claim 1, further including a lid rim boundary part (5) situated next to the chamber (29), wherein a bottom part (**5*a*) of the lid rim boundary part (5) extends to the imaginary conical surface (26**).

4. Injection-molded plastic lid according to claim 1, wherein a most inwardly situated flap (8) adjoins the second lid inside the rim part (4).

5. Injection-molded plastic lid according to claim 1, wherein the flaps (6, 7, 8) have a length from their bases to their free bottom (**9*a*, 9*b*, 9*c*) such that the flap parts (29*a*, 29*b*, 29*c*) situated outside the imaginary conical surface (26**) are essentially of equal lengths.

6. Injection-molded plastic lid according to claim 1, further including flaps having a V-shaped cross section in the direction of their free ends.

7. Injection-molded plastic lid according to claim 1, wherein the lid rim boundary part (5) has a smaller outside diameter than the outside diameter of the apron (17).

8. Injection-molded plastic lid according to claim 1, wherein a container having a first container upper rim part (15) divergently adjoining the inner wall and which adjoins, via a sharp top rim (28), an outwardly directed, downwardly sloping second container upper rim part (16) terminating in a downwardly directed apron (17) situated at a distance from the container wall, is provided with said lid.

* * * * *

UNITED STATES PATENT AND TRADEMARK OFFICE

CERTIFICATE OF CORRECTION

PATENT NO. : 4,955,504

DATED : September 11, 1990

INVENTOR(S) : Bernardus A. LESSCHER

It is certified that error appears in the above-identified patent and that said Letters Patent is hereby corrected as shown below:

IN THE CLAIMS:

Claim 6 should read as follows:

--6. Injection-moulded plastic lid according to claim 1, wherein the flaps have a V-shaped cross section in the direction of their free ends.--

Claim 7 should read as follows:

--7. Injection-moulded plastic lid according to claim 1, further including a lid rim boundary part (5) having a smaller outside diameter than the outside diameter of the apron (17).--

Signed and Sealed this

Thirty-first Day of December, 1991

*Attest:*

*Attesting Officer*

HARRY F. MANBECK, JR.

*Commissioner of Patents and Trademarks*